US007550027B2

(12) United States Patent
Sanui et al.

(10) Patent No.: US 7,550,027 B2
(45) Date of Patent: Jun. 23, 2009

(54) METHOD FOR SUPPLYING COVER GAS

(75) Inventors: Hiroshi Sanui, Kai (JP); Yuji Nomura, Kai (JP); Hidetoshi Ohta, Kofu (JP)

(73) Assignee: Taiyo Nippon Sanso Corporation, Tokyo (JP)

( * ) Notice: Subject to any disclaimer, the term of this patent is extended or adjusted under 35 U.S.C. 154(b) by 0 days.

(21) Appl. No.: 11/979,175

(22) Filed: Oct. 31, 2007

(65) Prior Publication Data

US 2008/0105087 A1 May 8, 2008

(30) Foreign Application Priority Data

Nov. 2, 2006 (JP) ..... P2006-299051

(51) Int. Cl.

| | |
|---|---|
| ***C22B 26/00*** | (2006.01) |
| ***C22C 1/06*** | (2006.01) |
| ***C22B 11/10*** | (2006.01) |
| ***C22B 9/00*** | (2006.01) |
| ***C22C 1/00*** | (2006.01) |

(52) U.S. Cl. ..... 75/600; 75/330; 75/392; 75/585; 75/594; 148/95

(58) Field of Classification Search ..... None
See application file for complete search history.

(56) References Cited

U.S. PATENT DOCUMENTS

| | | | | |
|---|---|---|---|---|
| 6,398,844 | B1 | 6/2002 | Hobbs et al. | |
| 6,537,346 | B2 * | 3/2003 | Milbrath et al. | 75/585 |
| 6,780,220 | B2 * | 8/2004 | Milbrath et al. | 75/602 |
| 2001/0027702 | A1 | 10/2001 | Hobbs et al. | |
| 2003/0034094 | A1 | 2/2003 | Milbrath et al. | |
| 2003/0164068 | A1 | 9/2003 | Milbrath et al. | |
| 2003/0164069 | A1 | 9/2003 | Milbrath et al. | |
| 2006/0144190 | A1 | 7/2006 | Sanui et al. | |

FOREIGN PATENT DOCUMENTS

| | | | |
|---|---|---|---|
| EP | 1 122 322 | A | 8/2001 |
| EP | 1 231 002 | A | 8/2002 |
| EP | 1 598 131 | A | 11/2005 |
| JP | 2004-276116 | | 10/2004 |
| JP | 2004 276116 | A | 10/2004 |
| JP | 2005-171374 | | 6/2005 |
| JP | 2005 171374 | A | 6/2005 |
| WO | WO 01/83836 | A | 11/2001 |
| WO | WO 2004/086279 | A | 10/2004 |
| WO | WO 2004/090177 | A | 10/2004 |

* cited by examiner

*Primary Examiner*—Melvin C Mayes
*Assistant Examiner*—Sarah Van Oudenaren
(74) *Attorney, Agent, or Firm*—Nixon & Vanderhye P.C.

(57) ABSTRACT

In order to provide a method for supplying a cover gas which has sufficient preventive effects of oxidation-combustion and prevents cost-increase by containing a necessary and sufficient amount of fluoroketone in the cover gas which is supplied in a melting furnace of magnesium, the present invention provides a method for supplying a cover gas containing fluoroketone in a melt furnace to prevent oxidation and combustion of a melt of magnesium in the melt furnace, wherein the moisture concentration of gas in the melt furnace is measured, and the concentration of fluoroketone in the cover gas is adjusted to a range from 1/50 to 1/5 relative to the moisture concentration.

4 Claims, 2 Drawing Sheets

METHOD FOR SUPPLYING COVER GAS

BACKGROUND OF THE INVENTION

1. Field of the Invention

The present invention relates to a method for supplying a cover gas used to prevent oxidation or combustion at the surface of a melt of magnesium or magnesium alloy (abbreviated as "magnesium" below).

Priority is claimed on Japanese Patent Application No. 2006-299051 filed on Nov. 2, 2006, the contents of which are incorporated herein by reference.

2. Description of the Related Art

The applicant of the present application suggested a gas containing fluoroketone and carbon dioxide gas as a cover gas in Japanese Unexamined Patent Applications, First Publication Nos. 2004-276116 and 2005-171374. Since the cover gas disclosed in those documents contains fluoroketone having a global warming potential lower than that of sulfur hexafluoride which has been used, the cover gas is expected to be used practically.

However, since fluoroketone is more expensive than sulfur hexafluoride, it is required to use it at low concentrations in the cover gas. Therefore, there is a case in which preventive effects of oxidation-combustion to the melt of magnesium decrease.

Therefore, the object of the present invention is to provide a method for supplying a cover gas which has sufficient preventive effects of oxidation-combustion and prevents cost-increase by containing a necessary and sufficient amount of fluoroketone in the cover gas which is supplied in a melting furnace of magnesium.

SUMMARY OF THE INVENTION

In order to achieve the object, the present invention provides a method for supplying a cover gas containing fluoroketone in a melt furnace to prevent oxidation and combustion of a melt of magnesium in the melt furnace, wherein the moisture concentration of gas in the melt furnace is measured, and the concentration of fluoroketone in the cover gas is adjusted to a range from 1/50 to 1/5 relative to the moisture concentration.

In the method for supplying a cover gas, it is preferable that the cover gas contain gas in addition to oxygen, the oxygen concentration of the gas in the melt furnace be measured, and the moisture concentration in the melt furnace be calculated based on the oxygen concentration and moisture amount in the ambient air outside the melt furnace.

In the method for supplying a cover gas, it is preferable that the cover gas contain an inert gas, the concentration of the inert gas of the gas in the melt furnace be measured, and the moisture concentration in the melt furnace be calculated based on the concentration of the inert gas and moisture amount in ambient air outside the melt furnace.

In the method for supplying a cover gas, it is preferable that the concentration of fluoroketone be in a range from 50 to 14,000 ppm in volume.

According to the method for supplying a cover gas of the present invention, the concentration of fluoroketone in the cover gas is adjusted to a necessary and sufficient amount to prevent oxidation-combustion of magnesium, fluoroketone is not used excessively, unnecessary cost-increase is prevented, and preventive effects of oxidation-combustion are reliably obtained.

DETAILED DESCRIPTION OF THE INVENTION

Figure 1:
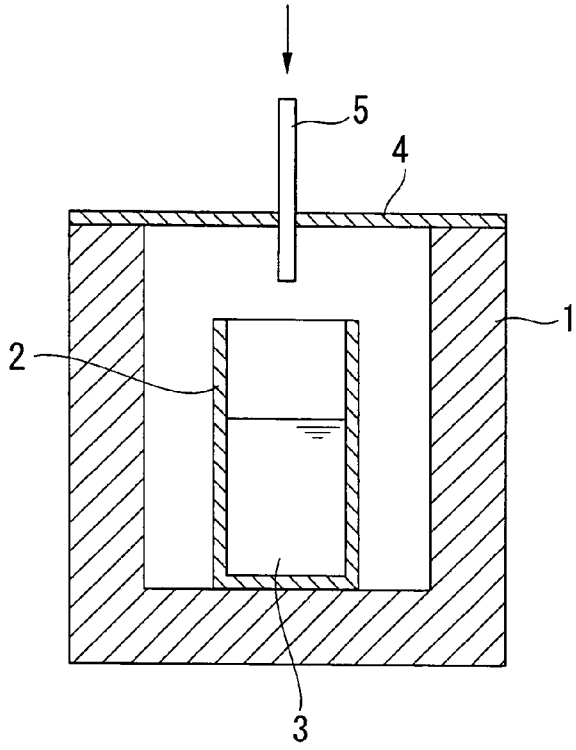
FIG. 1 is a skeleton framework showing one embodiment of the melt furnace for magnesium used in the present invention.

Preventive effects of oxidation-combustion of magnesium melt are exerted by reacting fluoroketone with magnesium to produce a protective film, covering the surface of the magnesium melt with the protective film, blocking the magnesium melt from oxygen, and thereby preventing oxidation-combustion of magnesium melt.

When magnesium exists with oxygen, the following severe oxidation reaction occurs.

$$Mg+\tfrac{1}{2}O_2 \rightarrow MgO+143.7\ \text{kcal/mol MgO}$$

Furthermore, when water exists in combustion of magnesium, magnesium reacts with water to produce heat and hydrogen. The larger amount of moisture is, the easier magnesium and water react, that is, the easier magnesium is combusted. In addition, the hydrogen produced by the reaction between magnesium and water sometimes reacts with oxygen in air and causes an explosion. Therefore, it is necessary to improve the preventive effects using the protective film.

$$Mg+H_2O \rightarrow MgO+H_2+75\ \text{kcal/mol MgO}$$

$$Mg+2H_2O \rightarrow Mg(OH)_2+H_2+82\ \text{kcal/mol Mg(OH)}$$

As explained above, when the amount of ambient air contaminated from the outside of the melt furnace in gas near the surface of the magnesium melt in the melt furnace is larger, and the moisture content in the gas near the melt surface is larger, possibility if combustion of the melt increases. Therefore, in order to increase the preventive effects of oxidation-combustion due to fluoroketone, it is necessary to increase the amount of fluoroketone in the gas in the melt furnace.

The preventive effects of oxidation-combustion due to the cover gas are evaluated based on the amount of dross generated at the surface of the magnesium melt. "Dross" is a mixture containing metal oxides, metal nitrides, and the like which are generated by contacting the surface of the melt of metal such as magnesium with ambient air. When the protective film due to the cover gas is made, the melt is blocked of air and dross is not generated.

Based on the results, the amount of dross generated is examined, and the preventive effects of oxidation-combustion are evaluated based on the amount of dross generated in the present invention.

For these reasons, it is necessary to increase the concentration of fluoroketone in the cover gas during considering the moisture content in ambient air entering the melt furnace, in order to obtain sufficient preventive effects of oxidation-combustion due to the cover gas containing fluoroketone.

As a method for supplying the cover gas in the melt furnace, there are a method in which fluoroketone is diluted with carbon dioxide gas, and is stored in a tank, then the diluted fluoroketone is supplied while it is further diluted with carbon dioxide gas or the like in order to adjust the concentration of fluoroketone to the necessary one, and a method in which fluoroketone is supplied from a tank filled with only fluoroketone while it is diluted with another gas. Both supplying methods can be used in the present invention. Mixture gas explained below is a mixture in gas state in the melt furnace.

The cover gas containing fluoroketone used in the present invention may contain non-oxidized gas such as carbon dioxide gas, argon, nitrogen as a diluent gas, in addition to fluoroketone. In addition, a mixture gas containing non-oxidized gas and a small amount of air may be added to fluoroketone as a diluent gas. Among these, carbon dioxide gas is preferable as a diluent gas, and the volume ratio of carbon dioxide gas in the diluent gas is preferably in a range from 25% to 100% in volume.

Examples of fluoroketone used in the present invention include perfluoroketone, hydrogenated fluoroketone, and a mixture thereof.

Among perfluoroketone, perfluoroketones having 5 to 9 carbon atoms are preferably used. Examples of the preferable perfluoroketones having 5 to 9 carbon atoms include $CF_3CF_2C(O)CF(CF_3)_2$, $(CF_3)_2CFC(O)CF(CF_3)_2$, $CF_3(CF_2)_2C(O)CF(CF_3)_2$, $CF_3(CF_2)_3C(O)CF(CF_3)_2$, $CF_3(CF_2)_5C(O)CF_3$, $CF_3CF_2C(O)CF_2CF_2CF_3$, $CF_3C(O)CF(CF_3)_2$, and perfluorocyclohexanone. These may be used alone or in combination.

Among hydrogenated fluoroketones, hydrogenated fluoroketones having 4 to 7 carbon atoms are preferable. Examples of the preferable hydrogenated fluoroketone having 4 to 7 carbon atoms include $HCF_2CF_2C(O)CF(CF_3)_2$, $CF_3C(O)CH_2C(O)CF_3$, $C_2H_5C(O)CF(CF_3)_2$, $CF_2CF_2C(O)CH_3$, $(CF_3)_2CFC(O)CH_3$, $CF_3CF_2C(O)CHF_2$, $CF_3CF_2C(O)CH_2F$, $CF_3CF_2C(O)CH_2CF_3$, $CF_3CF_2C(O)CH_2CH_3$, $CF_3CF_2C(O)CH_2CHF_2$, $CF_3CF_2C(O)CH_2CHF_2$, $CF_3CF_2C(O)CH_2CH_2F$, $CF_3CF_2C(O)CHFCH_3$, $CF_3CF_2C(O)CHFCHF_2$, $CF_3CF_2C(O)CHFCH_2F$, $CF_3CF_2C(O)CF_2CH_3$, $CF_3CF_2C(O)CF_2CHF_2$, $CF_3CF_2C(O)CF_2CH_2F$, $(CF_3)_2CFC(O)CHF_2$, $(CF_3)_2CFC(O)CH_2F$, $CF_3CF(CH_2F)C(O)CHF_2$, $CF_3CF(CH_2F)C(O)CH_2F$, and $CF_3CF(CH_2F)C(O)CF_3$. These may be used alone or in combination.

Among these, pentafluoroether-heptafluoropropylketones, that is, $C_3F_7(CO)C_2F_5$, for example, $CF_3CF_2C(O)CF(CF_3)_2$, and $CF_3CF_2C(O)CF_2CF_2CF_3$, are preferable.

The molecular weight of fluoroketone is preferably 250 or greater, and more preferably 300 or greater. The number of a carbonyl group in one fluoroketone molecule is preferably 1.

In the present invention, it is necessary to examine the moisture concentration of gas in the melt furnace. The moisture concentration can be determined by two methods.

The first method is a method used in a case that the cover gas contains gas other than oxygen such as carbon dioxide gas, argon, and nitrogen in addition to fluoroketone. In the method, an oxygen sensor for measuring the oxygen concentration of gas in the melt furnace is arranged, and the moisture concentration is calculated based on the oxygen concentration measured by the oxygen sensor.

In this case, when there is oxygen in the melt furnace, it means that ambient air enters the melt furnace from the outside thereof, and the oxygen concentration means the entering-degree of ambient air in the melt furnace. Since the oxygen concentration in ambient air is 20.9% by volume, when the oxygen concentration is 10.5% by volume, it is considered that half of the gas in the melt furnace is replaced with air. That is, the value, which is obtained by dividing the measured oxygen concentration (% by volume) with 20.9% by volume, means the mix rate of ambient air in the melt furnace.

The moisture concentration in ambient air per unit volume can be calculated based on a conversion table between relative humidity and temperature at the condition. Then the moisture concentration of gas in the melt furnace can be calculated by multiplying the mix rate with the moisture content in ambient air per unit. These are denoted by the following formula (1).

$$\text{The moisture concentration in the melt furnace (ppm by volume)} = (a/20.9) \times b \quad (1)$$

In the formula, "a" denotes the oxygen concentration (% by volume) in the melt furnace when oxidation-combustion of the magnesium melt is prevented, and "b" denotes the moisture concentration (ppm by volume) in ambient air per unit volume.

The second method is a method used in a case that the cover gas contains gas such as argon, and carbon dioxide gas which is other than main components of air such as oxygen and nitrogen. In the method, a sensor for measuring the concentration of inert gas of gas in the melt furnace such as argon, carbon dioxide is arranged, and the moisture concentration is calculated based on the concentration of inert gas measured by the sensor.

In this case, when the concentration of inert gas of gas in the melt furnace is less than 100% by volume, it means that ambient air enters the melt furnace from the outside, and inert gas is diluted with ambient air. The concentration of inert gas shows the entering-degree of ambient air in the melt furnace, that is, the mix rate of ambient air.

In addition, the moisture concentration in ambient air per unit volume can be calculated based on a conversion table between relative humidity and temperature at the condition, similar to the first method. Then, the moisture concentration of gas in the melt furnace can be calculated by multiplying the mix rate with the moisture concentration in ambient air per unit. These are denoted by the following formula (2).

$$\text{The moisture concentration in the melt furnace (ppm by volume)} = [(100-c)/100] \times b \quad (2)$$

In the formula, "c" denotes the concentration (% by volume) of inert gas in the melt furnace when oxidation-combustion of magnesium melt is prevented, and "b" denotes the moisture concentration (ppm by volume) in air per unit volume.

When the moisture concentration of gas in the melt furnace is calculated, the concentration of fluoroketone in the cover gas is adjusted to a range from 1/50 to 1/5 relative to the moisture concentration. When the concentration of fluoroketone is at least 1/50, less amount of dross is generated. When it exceeds 1/5, the amount of fluoroketone is too much to obtain the objective effects, and cost increases.

When contamination of ambient air in the melt furnace is small, and the moisture concentration in the melt furnace is considerably low, it can be anticipated that the calculated concentration of fluoroketone is less than 50 ppm. In such a case, the concentration of fluoroketone should be 50 ppm or more. When it is less than 50 ppm, the preventive effects of oxidation-combustion cannot sufficiently be obtained.

Below, the present invention is explained in detail referring to the following Examples.

EXAMPLE 1

The melt furnace shown in FIG. 1 was used. In FIG. 1, reference number 1 denotes a melt furnace. Inside of the melt furnace 1, a crucible 2 was arranged and heatable. The crucible 2 can be full of magnesium melt 3 obtained by heating.

In addition, a cover gas nozzle 5 was provided through a lid 4 of the melt furnace 1, a cover gas was supplied through the cover gas nozzle 5 toward the magnesium melt 3 in the crucible 2. In the Example, the inner diameter of the crucible 2 was 150 mm, and magnesium alloy (AZ91D) was put in the crucible 2 and heated to melt in the melt furnace 1. The distance between the nozzle 5 and the surface of the magnesium melt was 150 mm.

The supplying conditions until the temperature reached a melting temperature (650° C.) from heat-starting are as follows: the concentration of fluoroketone: 100 to 600 ppm; the diluent gas used: carbon dioxide gas; the flow rate of the cover gas: 4 L/min.

After the melt temperature reached 650° C., ambient air was introduced in the melt furnace while supplying the cover gas, and thereby the moisture concentration increased.

Moreover, the moisture concentration was calculated by measuring the concentration of oxygen in the melt furnace, and estimating the amount of ambient air introduced in the melt furnace.

While adjusting the amount of introduced ambient air such that the moisture concentration in the melt furnace is a fixed value, the crucible 3 was left at rest for 20 minutes. During the leaving at rest, the amount of dross at the surface of the magnesium melt was observed. The evaluation tests were performed on several days in different weather conditions, and the temperature was in a range from 20 to 30° C., and the humidity was in a range from 35 to 63%. The results are shown in Table 1 and FIG. 2. In Table 1, "Much" in Dross amount means that the phenomenon in growing dross such as oxides occurred. "Little" means that the surface of the magnesium melt was covered with the protective film, and ignition or the like did not occur.

TABLE 1

| Moisture concentration (ppm) | Fluoroketone concentration (ppm) | Dross amount |
|---|---|---|
| 2086 | 25 | Much |
| | 50 | Little |
| | 100 | Little |
| | 200 | Little |
| 2330 | 25 | Much |
| | 50 | Little |
| | 100 | Little |
| | 200 | Little |
| 5520 | 100 | Much |
| | 200 | Little |
| | 400 | Little |
| 9377 | 100 | Much |
| | 200 | Little |
| | 400 | Little |
| 14260 | 200 | Much |
| | 400 | Little |
| | 600 | Little |

Figure 2:
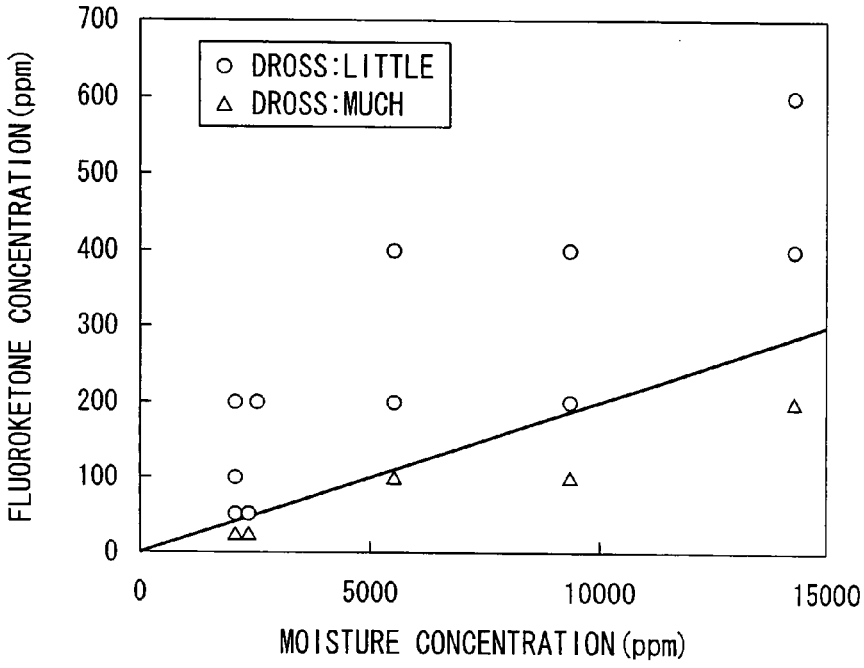
FIG. 2 shows results of the evaluation in Example 1.

It is clear from Table 1 and FIG. 2 that the generation of dross was prevented and fireproof effects-were obtained by adjusting the concentration of fluoroketone to 1/50 or more relative to the moisture concentration. The linear line in FIG. 2 is a line showing the ratio between the fluoroketone concentration and the moisture concentration being 1/50. Therefore, it is clear that when the fluoroketone concentration is 1/50 or more relative to the moisture concentration, the amount of the dross generated on the magnesium melt was little, and preventive effects of oxidation-combustion were achieved.

Moreover, in order to confirm the upper limit of the fluoroketone concentration, fluoroketone was supplied in the opened melt furnace, and the fireproof effects were evaluated. When the moisture concentration of ambient air was 7%, and the fluoroketone concentration was 1.4%, hydrogen fluoride (HF) was not detected. However, when the fluoroketone concentration exceeded 1.4%, hydrogen fluoride was gradually generated. When the fluoroketone is excessively supplied, and the excessive fluoroketone is hydrolyzed, hydrogen fluoride is generated.

It is clear from these results that the fluoroketone concentration is preferably 1/5 or less relative to the moisture concentration.

In addition, the moisture concentration in the melt furnace was calculated when the moisture concentration is 14,260 ppm, the temperature is 31° C., and the relative humidity is 61%.

When the temperature is 31° C., and the relative humidity is 61%, according to the conversion table between relative humidity and temperature, the concentration of the moisture in the ambient air is 27,115 ppm by volume. In the case that the oxygen concentration in the melt furnace in the conditions is 11% by volume, since the ambient air contains 20.9% by volume of oxygen, the mix rate is 0.526% (11/20.9=0.526%). Therefore, the moisture concentration in the melt furnace is 14,260 ppm by volume (27,115×0.526=14,260).

EXAMPLE 2

The best conditions of the nozzle 5 arranged in the melt furnace in Example 1 were examined.

A cover gas containing fluoroketone diluted at 200 ppm with carbon dioxide gas was supplied in the melt furnace 1 shown in FIG. 1. The area of the magnesium melt in the melt furnace was 0.4 $m^2$, and the temperature of the melt was 630° C. Under these conditions, the amount of dross generated was observed by varying a number of nozzles, and the distance between the melt surface and the tip of the nozzle. The results are shown in Table 2. The evaluation standards are the same as those in Table 1, except that "Extremely Little" means that dross was almost not recognized.

TABLE 2

| | Distance (mm) | | | | |
|---|---|---|---|---|---|
| | 50 | 100 | 150 | 200 | 250 |
| 1 nozzle | Much | Much | Much | Much | Much |
| 2 nozzles | Much | Little | Extremely Little | Little | Much |

When one number was used, it could be assumed that the cover gas was not supplied partly, and dross generated at the parts where the cover gas was not supplied. In addition, when the distance was 50 mm, the amount of dross generated is little at a part where the cover gas blown from the nozzle contacts directly. However, much dross is generated at other parts. When the distance was 250 mm, much dross is generated entirely including the part where the cover gas blown from the nozzle contacts directly.

It is clear from these results that the distance between the tip of the nozzle to the surface of the melt is preferably in a range from 100 mm to 200 mm, and one nozzle per 0.2 $m^2$ of the melt surface is preferably arranged.

EXAMPLE 3

Magnesium alloy (AZ91D) was put in the crucible 2 used in Example 1 and heated to melt. From heating starting to when the temperature of the alloy became the melt temperature (650° C.), the cover gas was supplied by adding carbon dioxide gas such that the fluoroketone concentration be 140 ppm at 4 L/min. of the flow rate. After the temperature of the melt reached 650° C., a part of carbon dioxide was changed to nitrogen to change the concentration of carbon dioxide. After changing the concentration of carbon dioxide, the melt was left at rest for 20 minutes, and the conditions of dross on the surface of the melt were observed. The results are shown in Table 3. Moreover, the number of the nozzle used was one, and the distance between the tip of the nozzles and the melt surface was 150 mm.

TABLE 3

| | | | | |
|---|---|---|---|---|
| $CO_2$ concentration (%) | 1 | 25 | 50 | 99.986 |
| $N_2$ concentration (%) | 98.986 | 74.986 | 49.986 | 0 |
| Fluoroketone concentration (%) | 0.014 | 0.014 | 0.014 | 0.014 |
| The amount of dross | Much | Little | Extremely Little | Extremely Little |

Figure 3:
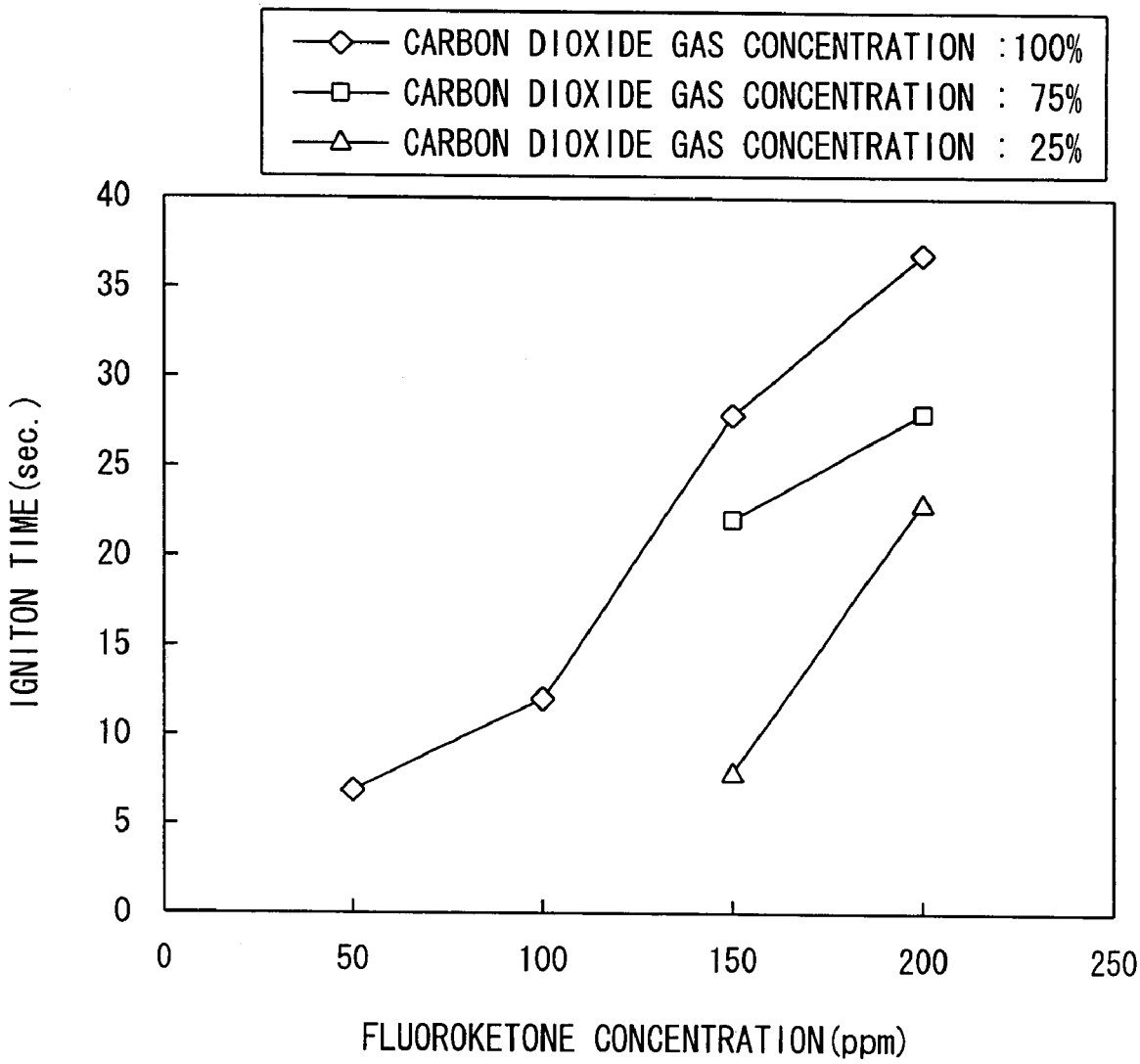
FIG. 3 shows results of the evaluation in Example 3.

In addition, the time from opening the lid 4 to ignition of the magnesium melt was examined in the same way, except that ambient air was used instead of nitrogen, and the concentration of fluoroketone varied from 50, 100, 150, and 200 ppm. The results are shown in Table 4 and FIG. 3. Moreover, "carbon dioxide: 100%" means that the diluent gas is only carbon dioxide.

TABLE 4

| | | $CO_2$ concentration (%) | | | |
|---|---|---|---|---|---|
| | | 1 | 25 | 75 | 100 |
| Fluoroketone Concentration (ppm) | 50 | — | — | — | 8 |
| | 100 | — | — | — | 12 |
| | 150 | — | 8 | 22 | 28 |
| | 200 | 1 | 23 | 28 | 37 |

It was confirmed from these results that when the concentration of carbon dioxide was 1%, the melt ignited immediately after opening the lid 4. It is clear that the higher the concentration of carbon dioxide gas is, the longer the time to ignition is. The effects of adding carbon dioxide in the diluent gas were confirmed.

It is best that the ignition time is longer, but the ignition time of 8 seconds or greater is sufficient in practical use. In this case, it is necessary to maintain the concentration of carbon dioxide diluted to be 25% or more. It is necessary that the concentration of fluoroketone used as a cover gas be 50 ppm or more.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A method for supplying a cover gas containing fluoroketone in a melt furnace to prevent oxidation and combustion of a melt of magnesium in the melt furnace, comprising: measuring the moisture concentration of gas in the melt furnace; and adjusting the concentration of fluoroketone in the cover gas to a range from 1/50 to 1/5 relative to the moisture concentration.

2. A method for supplying a cover gas according to claim 1, wherein the cover gas contains gas in addition to oxygen, and said measuring further comprises measuring the oxygen concentration of the gas in the melt furnace, and calculating the moisture concentration in the melt furnace based on the oxygen concentration and moisture amount in ambient air outside the melt furnace.

3. A method for supplying a cover gas according to claim 1, wherein the cover gas contains an inert gas, and said measuring further comprises measuring the concentration of the inert gas in the melt furnace, and calculating the moisture concentration in the melt furnace based on the concentration of the inert gas and moisture amount in ambient air outside the melt furnace.

4. A method for supplying a cover gas according to claim 1, wherein the concentration of fluoroketone is in a range from 50 to 14,000 ppm in volume.

* * * * *